US009668326B2

(12) United States Patent
Sellers et al.

(10) Patent No.: US 9,668,326 B2
(45) Date of Patent: May 30, 2017

(54) LIGHT FIXTURE WITH MULTIPLE DIMMING CAPABILITIES

(71) Applicant: CHAUVET & SONS, INC., Sunrise, FL (US)

(72) Inventors: Ford Hunter Sellers, Boca Raton, FL (US); Michael Graham, Davie, FL (US)

(73) Assignee: Chauvet & Sons, Inc., Sunrise, FL (US)

( * ) Notice: Subject to any disclaimer, the term of this patent is extended or adjusted under 35 U.S.C. 154(b) by 0 days.

(21) Appl. No.: 14/757,653

(22) Filed: Dec. 23, 2015

(65) Prior Publication Data

US 2016/0183339 A1 Jun. 23, 2016

Related U.S. Application Data

(60) Provisional application No. 62/096,063, filed on Dec. 23, 2014.

(51) Int. Cl.
*H05B 41/14* (2006.01)
*H05B 37/02* (2006.01)

(52) U.S. Cl.
CPC ..... *H05B 37/0272* (2013.01)

(58) Field of Classification Search
CPC ..... G06F 12/0207; G06F 12/04; G06F 13/16; G06F 13/28; G06F 9/3867; G06F 9/4436; G06F 12/0607; G06F 13/1673; G06F 13/1689; H01L 2924/00; H01L 2224/48091; H01L 2924/12032; H01L 2924/12044
See application file for complete search history.

(56) References Cited

U.S. PATENT DOCUMENTS

| | | | |
|---|---|---|---|
| 7,802,902 | B2 | 9/2010 | Moss et al. |
| 8,643,304 | B2 | 2/2014 | Hamel et al. |
| 2009/0184662 | A1 | 7/2009 | Given et al. |
| 2014/0072310 | A1 | 3/2014 | Yang et al. |
| 2014/0368204 | A1 | 12/2014 | Siessegger et al. |

FOREIGN PATENT DOCUMENTS

| | | | |
|---|---|---|---|
| WO | 2013110024 | A1 | 7/2013 |

*Primary Examiner* — Monica C King
(74) *Attorney, Agent, or Firm* — Laurence A. Greenberg; Werner H. Stemer; Ralph E. Locher

(57) ABSTRACT

A light fixture with multiple dimming capabilities is provided. More particularly, a device, system and method are provided for automatically sensing the presence of dimming signals from one or more power/voltage dimmers (i.e., phase-cut dimmers) and one or more data controllers providing dimming control signals according to a digital data controller protocol, and determining a priority between the two, for applying a dimming signal.

20 Claims, 2 Drawing Sheets

LIGHT FIXTURE WITH MULTIPLE DIMMING CAPABILITIES

CROSS-REFERENCE TO RELATED APPLICATIONS

The present application claims benefit of Provisional Patent Application No. 62/096,063, filed on Dec. 23, 2014; that application being incorporated herein, by reference, in its entirety.

BACKGROUND OF THE INVENTION

Field of the Invention

The present invention relates to a light fixture and, more particularly, to a light fixture capable of selectively varying the light intensity in response to variations in power and/or data.

Description of the Related Art

The use of dimmers to vary the intensity of light is common in light fixtures used in homes and commercial facilities and for other applications, such as stage lighting. Dimming of incandescent lights is typically accomplished by varying the power/voltage delivered to the lamp, through a process known as "phase-cut" or rheostat dimming, by sliding a switch or turning a knob. However, dimming of light emitting diodes (LEDs), which are being used in place of incandescent lights in many applications due to their greater efficiency and decreased operating costs, as well as some other light technologies, cannot be accomplished by varying the power/voltage in the same manner as incandescent lights. Because LEDs operate at significantly lower powers/voltages than incandescent lights, conventional dimmers (i.e., "triac dimmers" or "legacy dimmers") designed for incandescent lights do not function properly with LEDs, resulting in a significantly smaller dimming range. Instead, the intensity of LED fixtures is typically varied by sending data control signals to the LED drivers.

Light fixtures used in theaters, studios, auditoriums and other facilities for stage and studio lighting and other similar purposes, have traditionally used incandescent light sources and, therefore, the facilities have been built with power/voltage dimming systems. The inability of LED light fixtures to function properly with these legacy power dimming systems has been an impediment to the adoption of LED light fixtures in these existing facilities that have already invested significant resources to build the current infrastructure. These facilities and installations using incandescent lights and legacy power dimmers cannot simply add dimmable LED fixtures into the existing power infrastructure without also making substantial infrastructure changes to power the LED fixtures, because the LED fixtures will not operate properly, as the power in the existing infrastructure is varied to dim the incandescent lights co-existing in the system. This has resulted in facilities with incandescent lights continuing to use incandescent light fixtures rather than incorporating and transitioning to more cost effective LED fixtures. It also results in facilities with incandescent lights not having access to advanced lighting fixtures, features and technologies that are only offered with LEDs.

Accordingly, there is a need in the art for a new and improved lighting fixture that is capable of varying the light intensity using traditional incandescent light power/voltage variation dimmers and/or data control signals. Any such fixture should be capable of consistently varying the light intensity throughout the full dimming range regardless of whether the dimming is being driven by power/voltage variation or data control signals.

U.S. Patent Application Publication No. 2009/0184662 to Given et al., discloses dimming signal generation circuits used for differing types of power dimming signals, including dimming directly from a phase cut input AC line, DC voltage level dimming (e.g., 0-10V DC dimming) and/or pulse-width modulated (PWM) dimming. Additionally, the dimming level detection circuit of Given et al., may be configurable by component selection and/or by connection to different input connectors associated with at least two different types of power dimming signals.

Additionally, U.S. Pat. No. 8,643,304 to Hamel et al., discloses a dimming protocol detection for a light fixture for detecting a dimming protocol from a plurality of dimming protocols, such as a 0-10 volt lighting control, digital addressable lighting interface (DALI), digital multiplex (DMX512) lighting interface, a remote device management (RDM) interface, or a combination thereof. Additionally, Hamel et al., discloses a light fixture including a light dimming control module configured to control the plurality of lights based on the detected dimming protocol.

These prior art systems are structured for use with either power dimming signals or dimming control protocols. Neither discloses or suggests the ability to be used with both conventional power dimmers (i.e., phase cut dimmers) and data control dimmers, nor do they disclose or suggest the need for an LED light fixture that can be installed in legacy power dimming systems, and can operate in response to both traditional power dimming signals and digital data control signals, so that these existing facilities can begin to adopt LED light fixtures, and benefit from the advanced features, functionality and performance offered by LED light fixtures, without the need for significant investment in new infrastructure.

Accordingly, what is needed is a light fixture capable of automatically sensing the presence of dimming signals from power/voltage dimmers (i.e., phase-cut dimmers) and data control protocol dimmers and determining a priority for applying a dimming signal. For example, a light fixture is needed that can be used with legacy power dimmers and digital data control protocol dimmers such as, among others, digital multiplexing (DMX512 or DMX), ACN, ArtNet, KlingNet, Dali or any other data control protocol now known or later developed.

BRIEF SUMMARY OF THE INVENTION

The present invention is particularly suited to overcome those problems which remain in the art in a manner not previously known or contemplated. It is accordingly an object of the invention to provide a device, system and method for automatically sensing the presence of dimming signals from one or more power/voltage dimmers (i.e., phase-cut dimmers) and one or more data controllers providing dimming control signals according to a digital data controller protocol, and determining a priority between the two for applying a dimming signal. In one particular embodiment, the device is embodied in a light fixture. In another particular embodiment of the invention, the device determines whether a power dimming signal is less than a threshold to determine whether or not to vary the light intensity of a light based on the signal from a power dimmer or from a data controller. In a further embodiment, priority is given to a dimming signal from the power dimmer, over a dimming signal from a data controller.

Although the invention is illustrated and described herein as embodied in a light fixture with multiple dimming capabilities, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The foregoing background, as well as the following detailed description of the preferred embodiments, is better understood when read in conjunction with the appended drawings. For the purpose of illustrating the invention, there is shown in the drawings an exemplary embodiment that is presently preferred, it being understood however, that the invention is not limited to the specific methods and instrumentality's disclosed. Additionally, like reference numerals represent like items throughout the drawings. In the drawings.

DETAILED DESCRIPTION OF THE INVENTION

Before explaining the disclosed embodiment of the present invention in detail, it is to be understood that the invention is not limited in its application only to the details of the particular arrangement shown since the invention is capable of other embodiments. Also, the terminology used herein is for the purpose of description and not of limitation.

Figure 1:
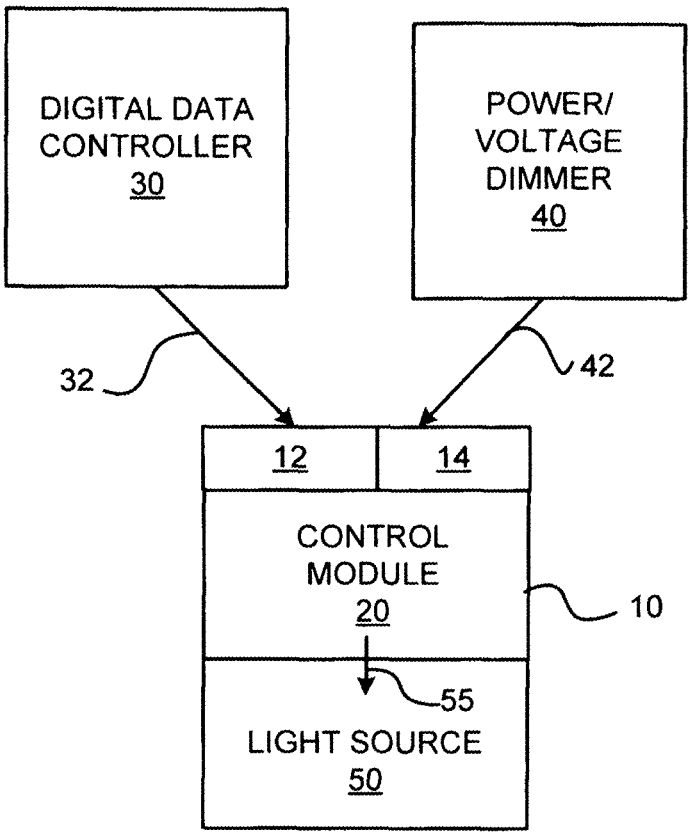
FIG. 1 is a simplified diagram showing a light fixture with multiple dimming source capabilities in accordance with one particular embodiment of the invention.

Referring now to FIG. 1, a light fixture 10 is provided that is capable of varying the light intensity output by the light fixture 10, in response to dimming control signals received from one or more traditional (i.e., legacy) incandescent light voltage variation dimmer switches 40 and one or more digital data controllers 30. The incandescent light voltage variation dimmer switch 40 is hereinafter referred to as the power dimmer or legacy dimmer 40, and the dimming signal received from the power dimmer 40 is hereinafter referred to as the power dimming signal 42.

The digital data controller 30 provides digital data control signals 32 in accordance with a data control protocol, such as, but not limited to, digital multiplexing (DMX512 or DMX), ACN, ArtNet, KlingNet, Dali or other known or later developed data control protocols. In one preferred embodiment, the digital data controller 30 is a digital multiplexing protocol (DMX) controller. DMX is a standard protocol for digital communication commonly used to control stage lighting and theatrical effects, including, but not limited to, moving lights, color changing lights and fog machines, and for color changing LED applications. Although a DMX controller is described in a preferred embodiment, it should be appreciated that the data control signal 32 may be provided in accordance with any other digital data control protocol now known or later developed.

The power dimmer 40 may be any technology now known or later developed structured to dim incandescent lights and other light technologies, including, but not limited to, a bidirectional triode thyristor or bilateral triode thyristor (TRIAC), a silicon-controlled rectifier (SCR), a rheostat or an insulated gate bipolar transistor (IGBT). Additionally, the power dimmer 40 may be connected to the fixture 10 through legacy wiring suitable for use with an incandescent fixture and power dimmer 40, or other wiring.

The light fixture 10 includes separate input ports 12, 14 to receive the data dimming signal 32 from the data controller 30 and the power dimming signal 42 from the power dimmer 40, respectively. Note that that is not meant to be limiting, as the data dimming signal 32 from the data controller 30 and/or the power dimming signal 42 from the power dimmer 40 may also be received by the light fixture 10 by wireless means without departing from the scope or spirit of the present invention.

The light fixture 10 includes, preferably therein, a control unit or module 20 structured to sense the presence of dimming signals 32, 42 from the data controller 30 and power dimmer 40. The control module 20 is particularly configured to analyze the dimming/control inputs 32, 42 and vary the light intensity output 55 responsively. In one particular embodiment of the invention, the control module 20 includes hardwired circuitry configured to particularly analyze the dimming signals 32, 42 and produce an output lighting signal 55. In another particular embodiment, the control module includes a microprocessor or microcontroller configured by software stored in non-transitory memory of the control module 20 that, when executed, particularly configures the microprocessor or microcontroller to perform the analysis of the input signals and the varying of the output signal. In a further embodiment of the invention, a combination of hardwired circuitry and a microprocessor or microcontroller particularly configured by software is used to perform the analysis of the dimming signals 32, 42 and to vary the light intensity output 55 according to the methods of the present invention.

Figure 2:
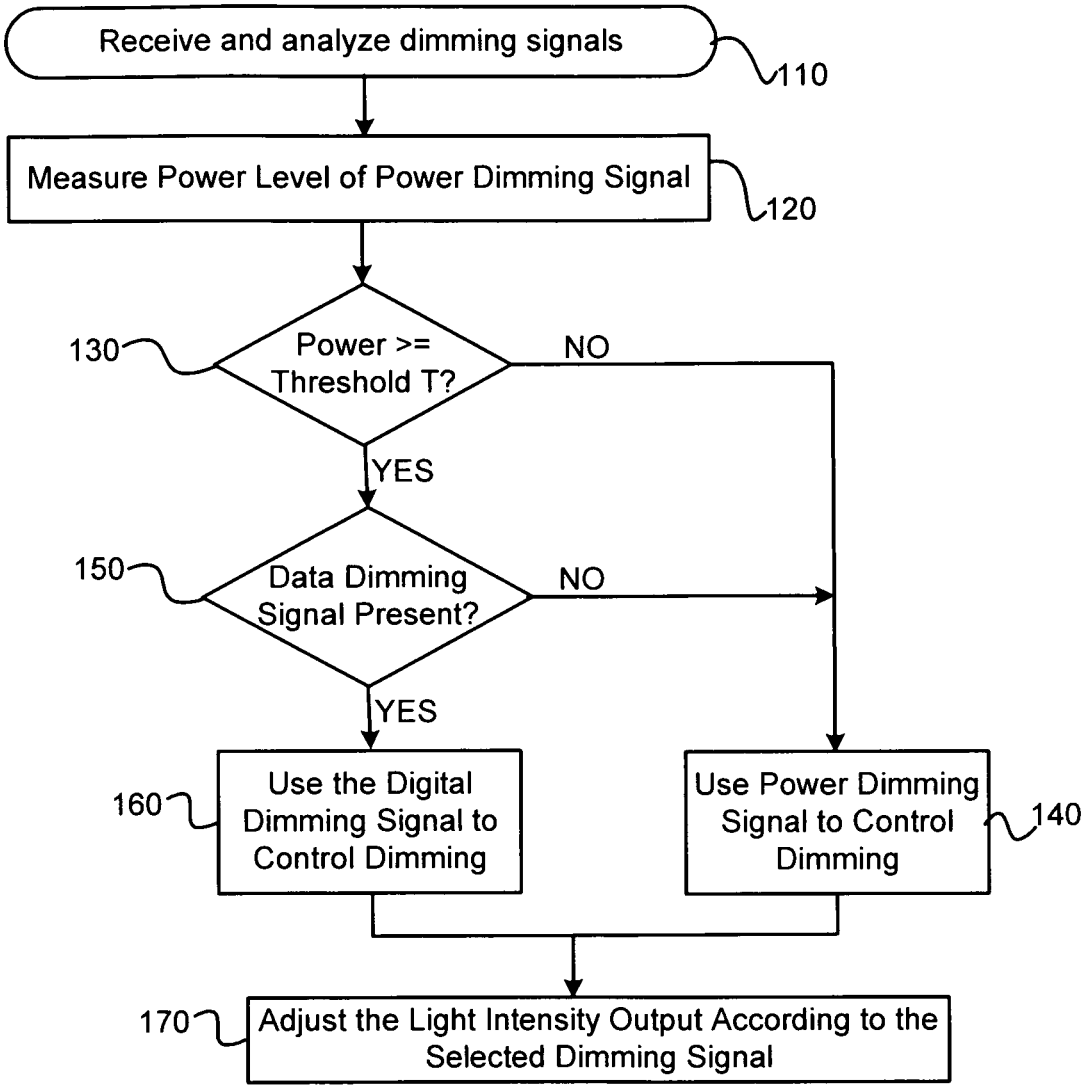
FIG. 2 is a basic flow diagram showing a method of operation for a fixture, such as the fixture of FIG. 1, in accordance with one particular embodiment of the invention.

More particularly, referring now to FIGS. 1 and 2, the control module 20 analyzes the dimming signals 32, 42 to selectively send the data dimming signal 32 or the power dimming signal 42, or a dimming signal derived from the data dimming signal 32 or the power dimming signal 42, to a light source 50, based on predefined selection criteria programmed into the control module 20. In one preferred embodiment, the control module 20 receives and analyzes the dimming signals 32, 42 to determine on which basis to vary the light intensity output 55. Step 110. More particularly, if the control module 20 detects that a power dimming signal 42 is present at the input port 14, the control module 20 measures the power level of that power dimming signal 42. Step 120. The measured power level of the power dimming signal 42 is then compared to a predefined threshold or level T set in the control module 20. Step 130. In one preferred embodiment, the predefined level T is eighty percent (80%) of the standard power level of electrical equipment in the particular geographic area (typically based on 120 volts or 240 volts). However, it should be appreciated that the predefined level may be set at any other desired level deemed appropriate to sense whether adequate power is present to vary the intensity of the particular light source throughout the full range of the light. Setting a threshold permits the system to account for voltage variations (voltage fluctuations, brown-outs, etc.) in the AC line voltage, without having the control module 20 attribute them to dimming.

If the measured power level of the power signal 42 is less than the predefined threshold T, the control module 20 will select the power dimming mode 44 and transmit the power dimming signal 42 to the light source 50. Step 140. If it is determined in step 130 that the power level of the power dimming signal 42 measured by the control module 20 is equal to or greater than the predetermined level T, the control module 20 will then sense whether or not a data dimming signal 32 is present. Step 150. As discussed above, the data dimming signal is a digital data control signal according structured according to a digital data protocol such as, but not limited to, DMX. Step 150. If no data dimming signal 32 is present, the control module 20 will select the power dimming mode 44 and transmit the power dimming signal 42, or a signal based on the power dimming signal 42, to the light source 50. Step 140. If the measured power was greater than or equal to the threshold and a data dimming signal 32 is present, the control module 20 will select the data dimming mode 34 and transmit the data dimming signal 32, or a signal based on the data dimming signal 32, to the light source 50. The light intensity output 55 will, therefore, be set according to the dimming signal selected by the control module 20, in accordance with the method described herein.

In a preferred embodiment, the light source comprises one or more LEDs or other solid-state lighting (SSL) devices. However, it should be appreciated that other light sources may be used within the spirit and scope of the present invention.

Although the embodiment described above measures the power level of the dimming signal, it should be appreciated that a voltage level or current level may alternatively be measured and compared with a predefined voltage or current level, respectively, in step 130, to determine whether to use the dimming signal from the legacy dimmer 40 (the prioritized selection) or the data dimming signal 32 from a data controller 30. As can be seen, the present invention gives priority to the power dimming signal 42 over that of the data dimming signal 32. In other words, if a power dimming signal 42 is present and below a threshold T, that signal is used to adjust the light intensity output, regardless of whether a data dimming signal 32 is also present. Only if the power dimming signal 42 is greater than or equal to the threshold T, does the control module 20 determine if a data dimming signal is present and should be used.

Although the embodiment of the lighting fixture 10 of the present invention describes the sensing of just two independent dimming control signals, one from a data controller 30 and the second from an incandescent light voltage variation dimmer switch 40, it should be appreciated that the dimming control signals can be sent from any other dimming control sources now known or later developed or can be received by the light fixture 10 of the present invention from more than two dimming control sources without departing from the scope or spirit of the invention.

While the invention has been described, disclosed, illustrated and shown in various terms of certain embodiments or modifications, which it has presumed in practice, the scope of the invention is not intended to be, nor should it be deemed to be, limited thereby and such other modifications or embodiments as may be suggested by the teachings herein are particularly reserved, especially as they fall within the breadth and scope of the claims here appended. Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

We claim:

1. A light control circuit for controlling a light source, comprising:

a control module configured to automatically sense the presence of a first dimming signal from a first dimmer, the first dimming signal being one of a power dimming signal, a voltage dimming signal and a current dimming signal;

the control module additionally configured to sense whether or not a data dimming signal from a data controller is present only if the control module has first determined that the power dimming signal is not present or does not meet a predefined selection criteria; and the control module further configured to selectively use one of the first dimming signal and the data dimming signal to vary an output to the light source based on predefined selection criteria.

2. The light control circuit of claim 1, wherein the control device is a microprocessor or microcontroller configured by software stored in a non-transitory memory device to select the dimming signal to be used.

3. The light control circuit of claim 1, wherein the control module is configured to determine a level of the first dimming signal and to use the first dimming signal, and not the data dimming signal, if the determined level is less than a predefined threshold.

4. The light control circuit of claim 3, wherein the predefined threshold level is 80% of a standard power level for the geographic area.

5. The light control circuit of claim 3, wherein the control module is configured to send the first dimming signal to the light source if the first dimming signal is less than the predefined threshold.

6. The light control circuit of claim 1, wherein the first dimmer is an AC phase-cut dimmer.

7. The light control circuit of claim 1, wherein the data controller provides a data dimming signal in accordance with a digital control protocol.

8. The light control circuit of claim 7, wherein the digital control protocol is a DMX or DMX512 digital multiplex protocol.

9. A light fixture, comprising the lighting control circuit according to claim 1.

10. A light control circuit for controlling a light source, comprising:

a first input for receiving a first dimming signal from a first dimmer, the first dimming signal being one of a power dimming signal, a voltage dimming signal and a current dimming signal;

a second input for receiving a data dimming signal from a data controller;

a control module configured to determine a level of the first dimming signal and compare the determined level to a predefined threshold level;

the control module additionally configured to use the first dimming signal to vary a light intensity of the light source, if the level of the first dimming signal is less than the predefined threshold level; and the control module further configured to determine whether a data dimming signal is present only after determining that the first dimming signal is not present or that the first dimming signal is not less than the predefined threshold level, and to use the data dimming signal to vary a light intensity of the light source only if the determined level of the first dimming signal is greater than or equal to the predefined threshold level.

11. The light control circuit of claim 10, wherein the first dimmer is an AC phase-cut dimmer.

12. The light control circuit of claim 10, wherein the data controller provides a data dimming signal in accordance with a digital control protocol.

13. The light control circuit of claim 12, wherein the digital control protocol is a DMX or DMX512 digital multiplex protocol.

14. The light control circuit of claim 10, wherein the predefined threshold level is 80% of a standard power level for the geographic area.

15. The light control circuit of claim 10, wherein the first input is a first port and the second input is a second port.

16. The light control circuit of claim 10, wherein the first input and second input receive the first dimming signal and data dimming signal, respectively, wirelessly.

17. A light fixture, comprising the lighting control circuit according to claim 10.

18. A method for controlling the intensity of a light source, comprising the steps of:

automatically sensing, with a control module, the presence of a first dimming signal from a first dimmer the first dimming signal being one of a power dimming signal, a voltage dimming signal and a current dimming signal;

determining with the control module a level of the first dimming signal and if the level meets a predefined selection criteria;

checking, with the control module, whether or not a data dimming signal is present from a data controller only if the level of the sensed first dimming signal does not meet the predefined selection criteria;

selecting, with the control module, one of the first dimming signal and the data dimming signal based on predefined selection criteria; and providing an output to the light source by the control module according to the selected dimming signal.

19. The method of claim 18, wherein the control module is configured to determine a level of the first dimming signal and to use the first dimming signal, and not the data dimming signal, if the determined level is less than a predefined threshold.

20. The light control circuit of claim 19, wherein the control module is configured to send the first dimming signal to the light source if the first dimming signal is less than the predefined threshold.

* * * * *